US005164107A

United States Patent [19]

Khan et al.

[11] Patent Number: 5,164,107

[45] Date of Patent: Nov. 17, 1992

[54] CHLORHEXIDINE COMPOSITION USEFUL IN A SURGICAL SCRUB

[75] Inventors: Mohammad A. Khan, Sandy; John F. Moellmer, Salt Lake City, both of Utah

[73] Assignee: Becton, Dickinson and Company, Franklin Lakes, N.J.

[21] Appl. No.: 690,316

[22] Filed: Apr. 25, 1991

[51] Int. Cl.[5] ..... C11D 3/48; C11D 3/065

[52] U.S. Cl. ..... 252/106; 252/535; 252/536

[58] Field of Search ..... 252/106; 514/635

[56] References Cited

U.S. PATENT DOCUMENTS

| | | | |
|---|---|---|---|
| 3,960,745 | 6/1976 | Billany et al. | 252/106 |
| 4,326,977 | 4/1982 | Schmolka | 252/106 |
| 4,420,484 | 12/1983 | Gorman et al. | 424/326 |
| 4,456,543 | 6/1984 | Owens | 252/106 |
| 4,715,982 | 12/1987 | Zabotto et al. | 252/174.17 |
| 4,919,837 | 4/1990 | Gluck | 252/106 |

FOREIGN PATENT DOCUMENTS

| | | |
|---|---|---|
| 1903379 | 7/1970 | Fed. Rep. of Germany . |
| 1057595 | 3/1954 | France . |
| 1246841 | 5/1969 | United Kingdom . |
| 2090 | 4/1986 | World Int. Prop. O. . |

OTHER PUBLICATIONS

Amerchol Corporation, product bulletin, Lanolin Derivatives and Other Specialties.

*Primary Examiner*—Ferris Lander
*Attorney, Agent, or Firm*—Richard E. Brown

[57] ABSTRACT

A cleansing composition particularly useful as a surgical scrub includes chlorhexidine gluconate and a nonylphenoxypoly(ethyleneoxy)ethanol surfactant in an aqueous vehicle, and may contain other surfactants, thickeners, emollients, dyes, perfumes and the like.

13 Claims, No Drawings

CHLORHEXIDINE COMPOSITION USEFUL IN A SURGICAL SCRUB

This application is a continuation of application Ser. No. 07/426,484, filed Oct. 23, 1989, which is a continuation-in-part of application Ser. No. 234,706, filed Aug. 22, 1988, both now abandoned.

BACKGROUND OF THE INVENTION

1. Field of the Invention

This invention relates to antimicrobial activity, and, more specifically, relates to antimicrobial cleansing compositions including chlorhexidine and a nonionic surfactant.

2 Background of the Invention

The antimicrobial effects of bisbiguanides have long been known. Chlorhexidine is the best known member of the class, and this product has been marketed for many years in various formulations such as antibacterial hand washes and surgical scrub compositions. These formulations generally include both a surface active agent and a low percentage of an alcohol, usually isopropanol.

Burdon et al. reported in 1967 that stock solutions of chlorhexidine frequently were contaminated with species of Pseudomonas, but that the combination of chlorhexidine and 4% V/V isopropanol greatly reduced this problem. Nevertheless, the authors speculated that continued use of isopropanol may ultimately result in selection of strains resistant to the chlorhexidine-isopropanol combination.

Billany et al., in U.S. Pat. No. 3,960,745, discloses a chlorhexidine cleansing composition formulated with a polyoxyethylene-polyoxypropylene nonionic surfactant. The Billany et al. formulation is marketed under the trade name Hibiclens ® by Stuart Pharmaceuticals, Wilmington, Del., a division of ICI Americas Inc. Billany et al. teaches that anionic, cationic and amphoteric surfactants all form complexes with chlorhexidine, and that of 17 nonionic surfactants studied, only four, all polyoxyethylene-polyoxypropylene surfactants, could be formulated with chlorhexidine with retention of 70% of the antimicrobial activity of a 2% solution of chlorhexidine gluconate. The patent further teaches that not even all members of this class are equally suitable for chlorhexidine formulations, and that complexation of the chlorhexidine with the surfactant results in a substantial reduction of the antibacterial activity of the chlorhexidine.

U.S. Pat. No. 4,420,484 to Gorman et al. discloses a skin cleansing composition consisting of a bisbiguanide antimicrobial agent and a combination of surfactants formulated with water, alcohol and various other ingredients. The Gorman et al. patent states that all ingredients in the patented composition are particularly described in the prior art.

Owens, in U.S. Pat. No. 4,456,543 shows an antibacterial cleansing product containing a bisbiguanide and one or more nonionic polyoxyalkylene surfactants containing oxyethylene, oxypropylene and oxybutylene blocks. Owens, like Billany et al., states that complexation of chlorhexidine and the surfactant results in a substantial reduction of antibacterial activity.

Chlorhexidine-containing compositions are marketed by Stuart Pharmaceuticals, Wilmington, Del., under the trade name Hibiclens ®; by Xttrium Laboratories, Inc., Chicago, Ill., under the trade name Exidine ®, by Medical Systems Research, Inc., Salt Lake City, Utah, under the trade name Steri Stat and by Huntington Laboratories, Inc., Huntington, Ind., under the trade name Cida-Stat.

Chlorhexidine cleansing compositions are used principally as hand washes and surgical scrubs. As such, it is desirable to effect the most complete kill possible of the bacterial flora which routinely proliferate on the skin. The principal organism existing on the skin is *Staphylococcus aureus*, an organism well-known to be resistant to antibacterial agents. Accordingly, there is a need for a chlorhexidine composition particularly effective against this organism. This invention addresses this and other needs.

SUMMARY OF THE INVENTION

An antimicrobial cleansing composition includes a salt of chlorhexidine and a nonylphenoxypoly(ethyleneoxy)ethanol surfactant in an aqueous vehicle. The preferred salt is the gluconate and is included in the composition in a concentration of about 4% by weight. (In the present disclosure, all percentages are by weight unless otherwise stated.) Other surfactants and thickening agents such as polyethyleneglycol (hereinafter PEG) esters of fatty acids, PEG ethers of lanolin and fatty acid amides may be included in the composition. Other ingredients such as dyes and perfumes may be added to give the composition any desired color and scent. The most preferred vehicle is water, and the pH may be adjusted to any desired level by adding acid or base as required.

All surfactants in chlorhexidine compositions are known to form complexes to a greater or lesser extent with the chlorhexidine. Chlorhexidine has long been believed to be deactivated by complexation wherein antibacterial activity resides only in that portion of the chlorhexidine which is not complexed. The composition of the present invention is formulated with a surfactant heretofore not disclosed in chlorhexidine formulations. The surfactant and chlorhexidine of the present composition are highly complexed, yet, in contrast to prior art reports, the formulation is highly effective, providing substantially total kill of *S. aureus* and other bacteria.

DETAILED DESCRIPTION

While this invention is satisfied by embodiments in many different forms, there will herein be described in detail preferred embodiments of the invention, with the understanding that the present disclosure is to be considered as exemplary of the principles of the invention and is not intended to limit the invention to the embodiments described. The scope of the invention will be measured by the appended claims and their equivalents.

The chlorhexidine in the present cleansing composition is 79% complexed with a particular surfactant, yet provides rapid and substantially complete kill of most bacteria, including *S. aureus*. In addition, the present composition provides all the other attributes of known chlorhexidine formulations, such as safety, mildness, emolliency, and sudsing. The advantages of the present composition are consequent to incorporation into the composition of a nonylphenoxypoly(ethyleneoxy)ethanol surfactant.

The concentration of chlorhexidine in the composition of the present invention may be about 1 to 10%, preferably 2 to 6%, most preferably 3.5 to 4.5%. Chlorhexidine base may be used, however a salt of chlorhexidine which is soluble in the formulation is preferred. Preferred salts are the hydrochloride, acetate, and most preferably, the gluconate. Chlorhexidine gluconate is commercially available from ICI Americas, Inc., Wilmington, Del.

Any aqueous vehicle which is compatible with the ingredients of the composition may be used. Preferred vehicles are aqueous alcohols, such as isopropanol or ethanol, mixtures of water and solvents such as dimethylsulfoxide, or, most preferably, pure water.

A nonionic surfactant of the nonylphenoxypoly(ethyleneoxy)ethanol type may be included in the composition of the invention. This class of surfactants is commercially available from GAF Corporation, Wayne, N.J., under the trade name Igepal®, and has the following formula:

$$C_9H_{19}—C_6H_5—O—(CH_2CH_2O)_{n-1}CH_2CH_2OH$$

where n is the number of molecules of ethylene oxide per molecule of nonylphenol. Preferred Igepal® surfactants have about 60 to 80, preferably about 66 to 75% ethylene oxide. The most preferred Igepal® surfactant of the invention is Igepal® CO -720 having about 71% ethylene oxide. It may be present in the composition in a concentration of 2 to 10%, preferably 4 to 6%, most preferably about 5% of the total weight of the composition.

In addition to the Igepal® surfactant, the composition of the invention may include additional nonionic surfactants. For example, a PEG ether of lanolin may be used. This class of surfactants is also commercially available, and may be obtained from Amerchol Corporation, Edison, N.J., under the trade name Solulan®. Preferred Solulan® surfactants have hydroxyl values of about 35 to 75. The most preferred Solulan® surfactant is Solulan® 75 having a hydroxyl value of 40–50. This product confers emulsifying and plasticizing properties to the composition and, in addition, being soluble in water, aids in solubilizing or dispersing other ingredients of the compositions. The quantity of the Solulan® surfactant in the composition may advantageously be from 3 to 7%, preferably 4.5 to 5.5%, most preferably about 5%.

Other ingredients which are conventional or desirable in various cosmetic formulations may be added to the composition of the invention. For instance, one or more thickening agents may be advantageous. Particularly useful thickening agents are fatty acid esters of PEG having a molecular weight of about 200 to 6000. For example, PEG esters of lauric acid, oleic acid, and, most preferably stearic acid, such as PEG-6000 distearate may be used. This product is commercially available from Stepan Co., Northfield, Ill., as Kessco® PEG-6000. Fatty acid amide thickening agents may be used, such as ammonia, ethanolamine and diethanolamine amides of oleic acid, coco acid, or preferably, lauric acid. A particularly preferred thickening agent is lauric acid diethanolamide, commercially available from Witco Chemical Corporation Houston, Tex., under the trade name Witcamide® 5195. Both of these products may be used within a range of 2 to 5%, preferably 3 to 4%, most preferably about 3.5% and provide conditioning, emulsifying and foam stabilizing properties to the composition in addition to being thickeners.

If desired, the composition of the invention may include a perfume to provide a pleasing scent or a dye to provide a characteristic color. The preferred composition is colored red by inclusion of sufficient Red #40 to achieve the desired color. Most preferably, a concentration of about 0.01% of Red #40 is added to the composition.

It is preferred that the pH of the composition be adjusted to about 7.0 by addition of a suitable acidifying or alkalinizing agent, such as 6N hydrochloric acid or 50% sodium hydroxide.

The present invention is more particularly described by means of, but not limited to, the following examples.

EXAMPLE I

Preferred Composition of the Invention

| | |
|---|---|
| Chlorhexidine gluconate | 4.1% |
| Igepal® CO-720 | 5.0% |
| Solulan® 75 | 5.0% |
| Witcamide 5195 | 3.5% |
| PEG-6000 distearate | 3.5% |
| Red #40 | 0.01% |
| Water | 78.89% |

EXAMPLE II

Method of Manufacture of the Composition of Example I

In a suitably sized vessel equipped for mixing was placed 61.18 g of purified water and 21.81 g of an 18.8% water solution of chlorhexidine gluconate B.P. After mixing well, 5.0 g of Igepal® CO-720 was added slowly and mixed well. Solulan® 75, 5.0 g, was heated to 55° C. until melted and then added with thorough mixing. Witcamide® 5195, 5.0 g, was melted by heating to 40° C. and added with thorough mixing. PEG-6000 distearate, 3.5 g, was added and the mixture was vigorously mixed until complete homogeneity had been achieved and no flakes remained. Red #40 dye (10 mg) was added and the mixture was stirred until a clear, red, syrupy liquid was obtained. The mixture was adjusted if necessary to pH 7.0 by the addition of either 6N HCl or 50% NaOH.

EXAMPLE III

Determination of Percentage of Complexation Between Chlorhexidine and Surfactant This determination was made in accordance with the procedure of Owens, supra and gave the data summarized in Table I.

TABLE I

| | 20 Hour Equilibration Time | | 72 Hour Equilibration Time | |
|---|---|---|---|---|
| Sample No. | % Complexed | % Uncomplexed | % Complexed | % Uncomplexed |
| 1 | 26 | 74 | 13 | 87 |
| 2 | 79 | 21 | 72 | 28 |
| 3 | 0 | 100 | | |
| 4 | 73 | 27 | | |
| 5 | 77 | 23 | | |
| 6 | 82 | 18 | | |
| 7 | 79 | 21 | | |

TABLE I-continued

| Sample No. | 20 Hour Equilibration Time % Complexed | 20 Hour Equilibration Time % Uncomplexed | 72 Hour Equilibration Time % Complexed | 72 Hour Equilibration Time % Uncomplexed |
|---|---|---|---|---|
| 8 | 86 | 14 | 83 | 17 |

Key for sample number:
1 Hibiclens ®
2 Composition of Example I
3 4% chlorhexidine gluconate in water
4 Composition of Example I, but Igepal ® Co-720 replaced with Igepal ® CA-897
5 Composition of Example I, but Igepal ® Co-720 replaced with Igepal ® CO-710
6 Composition of Example I, but Igepal ® Co-720 replaced with Igepal ® CO-660
7 Composition of Example I, but Igepal ® Co-720 replaced with Igepal ® CA-630
8 Composition of Example I, but Solulan ® 75 replaced with Solulan ® 5

EXAMPLE IV

Efficacy Test

The composition of Example I was irradiated (3.1 Mrad) to ensure sterility and an efficacy comparison against Hibiclens ® was carried out by the following procedure:

Full strength composition (C), irradiated composition (C-I) and Hibiclens ® (H) were serially diluted 1:10; 1:100 and 1:1000. Each dilution was challenged with 0.1 ml of inoculum containing the number of colony forming units (CFU) of the 4 organisms given in Table II below. After exposure times of 1,2 and 5 minutes, 1.0 ml of each inoculated dilution was transferred to a tube containing 9 ml of Difco Dey Engley neutralizing broth. Samples (1.0 ml) of each dilution in neutralizing broth were further diluted into 9 ml of Difco Dey Engley neutralizing broth base. All tubes were then incubated at 30° to 35° C. for 48 hours. Nutrient agar pour plates were prepared from each tube and examined for the presence of colonies after a minimum of 48 hours. The results of this experiment are given in Table II below.

TABLE II

| ORGANISM | DILUTIONS | KILL TIMES (Minutes) H | C | C-I |
|---|---|---|---|---|
| 1. *Staphylococcus aureus* | Full | Pos. | 1 | 1 |
| $4.7 \times 10^6$ CFU | 1:10 | Pos. | 1 | 1 |
| | 1:100 | 2 | 1 | 1 |
| | 1:1000 | Pos. | 5 | Pos. |
| 2. *Pseudomonas aeruginosa* | Full | 1 | 1 | 1 |
| $8.5 \times 10^6$ CFU | 1:10 | 1 | 1 | 1 |
| | 1:100 | 1 | 5 | 2 |
| | 1:1000 | 5 | Pos. | 5 |
| 3. *Candida albicans* | Full | 1 | 1 | 1 |
| $3.10 \times 10^5$ CFU | 1:10 | 1 | 1 | 1 |
| | 1:100 | 1 | 1 | 1 |
| | 1:1000 | 2 | 2 | 2 |
| 4. *Escherichia coli* | Full | 1 | 1 | 1 |
| $6.2 \times 10^6$ CFU | 1:10 | 1 | 1 | 1 |
| | 1:100 | 1 | 2 | 5 |
| | 1:1000 | 5 | 2 | 5 |

Pos.-colonies observed, total kill not achieved.

This test demonstrates that the composition of the invention was significantly more effective than Hibiclens ® versus *S. aureus* in spite of the fact that it is 79% complexed in contrast to Hibiclens which is only 26% complexed. The results versus the other organisms were identical through the 1:10 dilutions and similar at other dilutions. It is seen from Table II that irradiation of the composition did not significantly affect the antimicrobial efficacy of the composition, and that the irradiated composition is an effective antimicrobial cleansing composition.

Thus, the invention provides a cleansing composition which includes a chlorhexidine salt highly complexed with a nonionic nonylphenoxypoly(ethyleneoxy)ethanol surfactant. The composition of the invention including this particular surfactant has activity against *S. aureus* significantly greater than a prior art composition in which the degree of complexation is much lower. This result is completely unexpected in light of the heretofore generally accepted view that activity and complexation are inversely related. Since *S. aureus* is a commonly found organism on skin and is often difficult to kill completely, the composition of the invention represents a marked and unexpected improvement over prior art cleansing compositions.

What is claimed is:

1. An antimicrobial cleansing composition comprising:

a) about 3 to 6% of a chlorhexidine sale;

b) about 4 to 6% of a nonylphenoxypoly(ethyleneoxy)ethanol surfactant;

c) at least one thickening agent selected from the group consisting of about 2 to 5% of a polyethyleneglycol diester of a first fatty acid and about 2 to 5% of an amide of a second fatty acid;

d) about 3 to 7% of a polyethyleneglycol ether of lanolin surfactant derived from the ethoxylation of an unsaponified lanolin; and e) water.

2. The composition of claim 1 wherein said salt is selected from the group consisting of the hydrochloride, acetate and gluconate.

3. The composition of claim 1 wherein the ethyleneoxy percentage in said nonylphenoxypoly(ethyleneoxy)ethanol is from about 60 to 80.

4. The composition of claim 1 wherein said polyethyleneglycol ether of lanolin has a hydroxyl value of about 35 to 75.

5. The composition of claim 1 wherein said first fatty acid is stearic acid.

6. The composition of claim 5 wherein said polyethyleneglycol diester has a molecular weight of about 200 to 6000.

7. The composition of claim 1 wherein said second fatty acid is lauric acid.

8. The composition of claim 7 wherein said amide is selected from the group consisting of amides of ammonia, ethanolamine and diethanolamine.

9. The composition of claim 1 further comprising a dye.

10. The composition of claim 1 further comprising a pH adjusting compound selected from the group consisting of an acid and a base.

11. An antimicrobial cleansing composition consisting essentially of:

a) about 4% of chlorhexidine gluconate;

b) about 5% of a nonylphenoxypoly(ethyleneoxy)ethanol having about 71% of ethylene oxide;

c) about 5% of a polyethyleneglycol ether of lanolin surfactant derived from the ethoxylation of an unsaponified lanolin;

d) about 3.5% of a polyethyleneglycol distearate;

e) about 3.5% of lauric acid diethanolamide; and f) water wherein all percentages are by weight.

12. The composition of claim 11 which also includes a dye.

13. The composition of claim 11 which also includes a sufficient quantity of a pH adjusting compound selected from the group consisting of an acid and a base to adjust the pH of said composition to about 7.

* * * * *